US010731362B2

(12) United States Patent
Rogers

(10) Patent No.: US 10,731,362 B2
(45) Date of Patent: Aug. 4, 2020

(54) HORIZONTAL SCAFFOLD SUPPORT COMPONENT

(71) Applicant: ATLANTIC PACIFIC EQUIPMENT, INC., Roswell, GA (US)

(72) Inventor: Peter Rogers, Roswell, GA (US)

(73) Assignee: Atlantic Pacific Equipment, Inc., Roswell, GA (US)

( * ) Notice: Subject to any disclaimer, the term of this patent is extended or adjusted under 35 U.S.C. 154(b) by 0 days.

(21) Appl. No.: 15/757,241

(22) PCT Filed: Sep. 2, 2016

(86) PCT No.: PCT/US2016/050127
§ 371 (c)(1),
(2) Date: Mar. 2, 2018

(87) PCT Pub. No.: WO2017/040944
PCT Pub. Date: Mar. 9, 2017

(65) Prior Publication Data

US 2018/0251989 A1 Sep. 6, 2018

Related U.S. Application Data

(60) Provisional application No. 62/213,186, filed on Sep. 2, 2015.

(51) Int. Cl.

| | |
|---|---|
| ***E04G 1/14*** | (2006.01) |
| ***E04G 1/15*** | (2006.01) |
| ***E04G 7/14*** | (2006.01) |
| ***E04G 7/32*** | (2006.01) |

(52) U.S. Cl.
CPC ..... *E04G 1/14* (2013.01); *E04G 1/15* (2013.01); *E04G 7/14* (2013.01); *E04G 7/32* (2013.01)

(58) Field of Classification Search
CPC ..... E04G 7/32; E04G 7/14; E04G 1/14
USPC ..... 182/186.7, 186.8
See application file for complete search history.

(56) References Cited

U.S. PATENT DOCUMENTS 5,024,037 A 6/1991 Ono
6,675,546 B2 * 1/2004 Coles ..... F16B 7/185 403/157
7,024,834 B2 4/2006 Gimpel
(Continued)

FOREIGN PATENT DOCUMENTS

CA 2854218 A1 * 12/2015 ..... E04G 1/06
CN 102373799 A 3/2012
(Continued)

OTHER PUBLICATIONS

PCT/US01650127 received an International Search and Written Report dated Dec. 1, 2017, 16 pages, search report is in English.
(Continued)

*Primary Examiner* — Alvin C Chin-Shue
(74) *Attorney, Agent, or Firm* — Barnes & Thornburg LLP

(57) ABSTRACT

A modified scaffold component for use in modular scaffold systems allows securement to vertical uprights in a conventional manner and allows a work surface to pass over supporting uprights (if desired) to form a continuous work surface where securement of the modified scaffold component is below and does not interrupt the work surface.

12 Claims, 16 Drawing Sheets

(56) References Cited

U.S. PATENT DOCUMENTS

| | | | | |
|---|---|---|---|---|
| 8,366,068 | B2 * | 2/2013 | Schmied | E04G 1/14 248/229.12 |
| 9,650,779 | B2 * | 5/2017 | Tello | E04B 1/2403 |
| 2013/0330117 | A1 * | 12/2013 | Kreller | E04G 7/307 403/49 |

FOREIGN PATENT DOCUMENTS

| | | | | |
|---|---|---|---|---|
| CN | 202450763 | U * | 9/2012 | |
| CN | 103038430 | A | 4/2013 | |
| EP | 0383317 | A1 * | 8/1990 | E04G 1/14 |
| EP | 1016766 | A1 * | 7/2000 | E04G 1/04 |
| EP | 1785549 | A1 | 11/2005 | |
| ES | 2228223 | A1 | 4/2005 | |
| GB | 877463 | A | 9/1961 | |
| JP | H06299691 | A | 10/1994 | |
| JP | H07279418 | A | 10/1995 | |
| NL | 9100819 | A | 12/1992 | |
| WO | 02/077396 | A1 | 10/2002 | |
| WO | 2012/014581 | A1 | 2/2012 | |
| WO | WO-2012014581 | A1 * | 2/2012 | E04G 7/22 |

OTHER PUBLICATIONS

EP16843075.9 received an Extended European Search Report dated Apr. 24, 2019, 7 pages.

Garcia Vega S.A.S., Manual para armado de andamio multidireccional. (2013). Version 04 del Feb. 14, 2013. Available at: https://garciavega.co/wp-content/uploads/2019/05/Manual_Armado__Andamio41_compressed.pdf).

Protolabs, manufacturing acceletared. Fortallecer estructuras: elegir materiales y soportes. (2014). Available at: https:l/www.protolabs.es/recursos/sugerencias-de-diseno/fortalecei'-estructuras/- (See Also: https://www.protolabs.es/servicios/moldeo-por-inyeccion/).

* cited by examiner

CAPPING PIECE

CAPPING PIECE

END VIEW OF RAISED
HORIZONTAL MEMBER

HORIZONTAL SCAFFOLD SUPPORT COMPONENT

This application claims priority of U.S. Provisional Application Ser. No. 62/213,186 filed Sep. 2, 2015 and the entire contents of Provisional Application Ser. No. 62/213,186 is incorporated herein by reference.

FIELD OF THE INVENTION

The present invention relates to horizontal scaffold support components that are capable of being used to define a work platform thereabove. In particular, the invention includes a horizontal scaffold support component used to form a continuous working platform which is supported by and extends across a vertical support member.

BACKGROUND OF THE INVENTION

Modular scaffold support systems are commonly used to provide vertical support for structures as well as for use in defining a raised work platform adjacent a structure. Scaffold systems are also used for providing temporary structures such as work platforms or removable bleacher-type seating.

One of the most common scaffolding system is modular and is designed to allow convenient connection of horizontal members to tubular steel upright members. The tubular steel upright members have a series of connecting members positioned in the length of the vertical upright and the horizontal members include at the ends thereof a component designed to connect with any of a series of connecting nodes provided on vertical upright scaffold members. This type of modular connection of scaffold components is convenient and requires less expertise in the assembly of support structures or raised platforms.

FIG. 1 in the drawings shows a portion of a lower vertical member 2 about to be mechanically connected to an upper vertical member 4. As can be see the upper vertical member 4, which is a tubular steel component, slides over the spigot 6 which is mechanically secured to the lower vertical member 2. Often this slide connection is locked using a locking pin. A connecting rosette 8 is shown and is one of several connecting rosettes that are positioned in accordance with a modular spacing in the length of each of the vertical members 2 and 4. These rosettes or other mechanical type connections are provided at fixed points on the vertical uprights and allow fast connection using ledger heads and drop wedges that are used to mechanically secure a horizontal member of the modular scaffolding system to a vertical member.

Typically the spigot 6 that is mechanically secured to the vertical upright 2, can be released form the vertical upright. For example, the spigot can have a pin connection with the vertical upright or in some circumstances, will have a mechanical bolt and nut type securement. In any event, the spigot 6 can be removed from the vertical upright 2 without damage to the vertical upright 2.

FIGS. 2 and 3 illustrate Prior Art arrangements for defining a top working platform 20. As can be seen in FIG. 2 the work platform 20 is supported on the lower side thereof by horizontal load bearing members 12 which are mechanically connected to the upright 2 by means of the drop wedge and ledger header arrangement shown as 24.

With the arrangement shown in FIGS. 2 and 3, the work platform 20 is at or slightly below the top of the drop wedge connectors 26 which are provided adjacent each upright 2.

In addition, the spigot 6 of the vertical upright 2 projects well above the working platform 20. With this arrangement the working platform 20 is essentially interrupted where each upright 2 projects through the work surface. The work surface is not continuous over the upright 2 and in fact a large portion of the upright 2 and various connecting arrangements project above the work surface and present a trip hazard.

The Prior Art structure shown in FIG. 3 has a work surface 20 that is continuous between uprights but is interrupted at the uprights. Although the work surface is shown in one dimension, additional horizontal members 12 would extend in a perpendicular direction for connecting with further upright members. The existing modular scaffolding system can be used for providing essentially continuous work platforms between uprights but the uprights 2 interrupt this continuous work surface and the connection component can form trip hazards when the uprights are intermediate the perimeter of the work surface 20.

The present invention provides a solution that can be used with existing modular scaffolding systems that use vertical members with a spigot type connection for connecting vertical members in an end-to-end manner. Although specific reference is made to a spigot connection for forming of a connection between vertical members, other mechanical fasteners that allow for end to end securement of vertical members of a scaffolding system can also be adapted using the principles of the present invention.

SUMMARY OF THE INVENTION

A horizontal scaffold component according to the present invention comprises an elongate top support member for supporting platform members. The elongate top support member at opposite ends thereof has a connecting member adapted to releasably connect with a conventional scaffold type upright. The connecting members are located downwardly of the elongate top support member and include a drop wedge movable downwardly into the connecting member for releasably connecting with conventional scaffold type uprights. Each drop wedge is movable upwardly towards the elongate top support into a clear space between the elongate top support member and the respective connecting member.

In a preferred aspect of the invention, each connecting member includes a ledger head and the respective drop wedge is captured on the ledger and movable between a release position and an engaged position.

In a further aspect of the invention each drop wedge includes at a top thereof outwardly extending hammer pads.

In a different aspect of the invention each drop wedge includes separate reinforcing ribs extending vertically alongside edges of the drop wedge and downwardly from the hammer pads.

In a preferred aspect of the invention each reinforcing rib is a metal rib welded to the drop wedge on a side of the drop wedge and secured at a vertical edge of the drop wedge. Preferably each drop wedge includes four reinforcing ribs.

In an aspect of the invention the horizontal scaffold component is used in combination with a "T" shaped capping component. This capping component includes a downwardly extending spigot connection and a top member that extends across the spigot connection. Vertically extending locating tabs are centered on the top member with the locating tabs located at opposite ends of the top member.

In a preferred aspect of the invention, the horizontal scaffold component includes vertically extending slots at opposite ends of the elongate top member. The slots are sized to receive a locating tab of the "T" shaped capping component tab to align the top member of the capping component with the elongate top member.

According to an aspect of the invention, the "T" shaped capping component includes a projecting support surface extending outwardly from the spigot connection at a position spaced below the top member a distance to assist in aligning the top member with the elongate top member for supporting a platform.

BRIEF DESCRIPTION OF THE DRAWINGS

Preferred embodiments of the invention are shown in the drawings, wherein:

FIG. 1 is a side view showing a spigot type connection for mechanically connecting one vertical member to a second vertical member in an end-to-end manner;

FIG. 2 is a partial side view showing further details of the Prior Art modular scaffolding system where an upright has two horizontal load bearing members secured thereto and a supported work platform;

FIG. 3 is a further side view showing two vertical members and a number of horizontal members for supporting of a work platform relative to the vertical members;

DETAILED DESCRIPTION OF THE PREFERRED EMBODIMENTS

Figure 1:
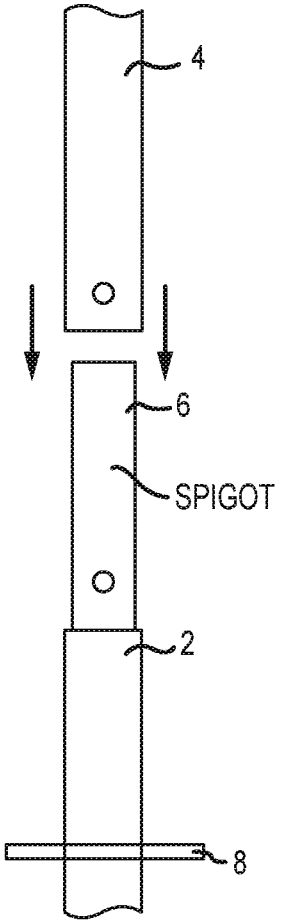
FIG.1 PRIOR ART
FIGS. 1, 2 and 3 illustrate existing modular scaffolding systems and in particular a common connection arrangement used to connect uprights of a modular scaffolding system using ledgers.
Figure 2:
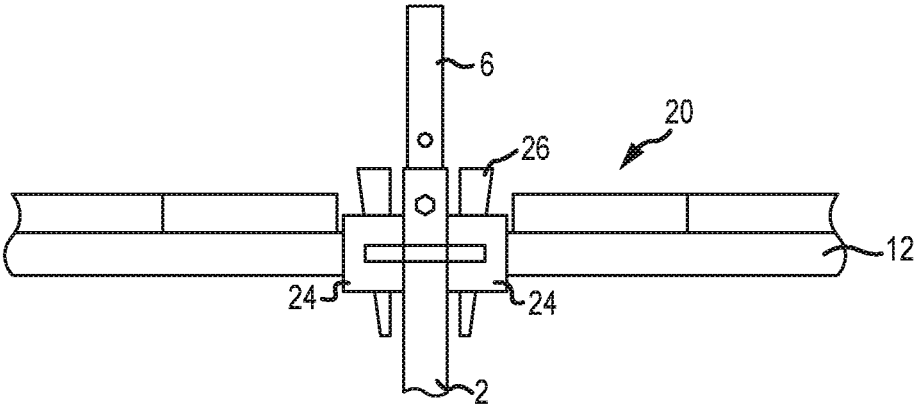
FIG.2 PRIOR ART
Figure 3:
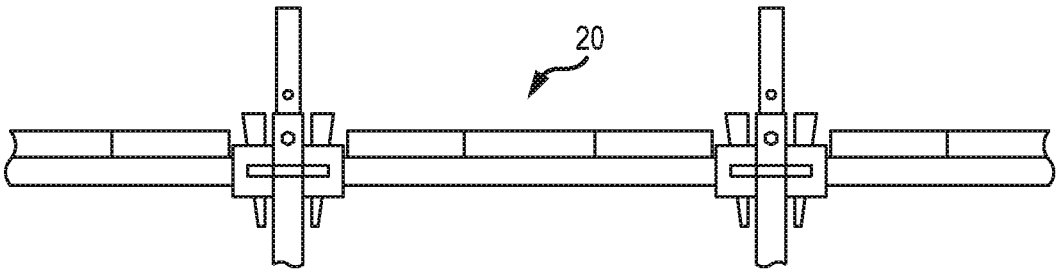
FIG.3 PRIOR ART
Figure 4:
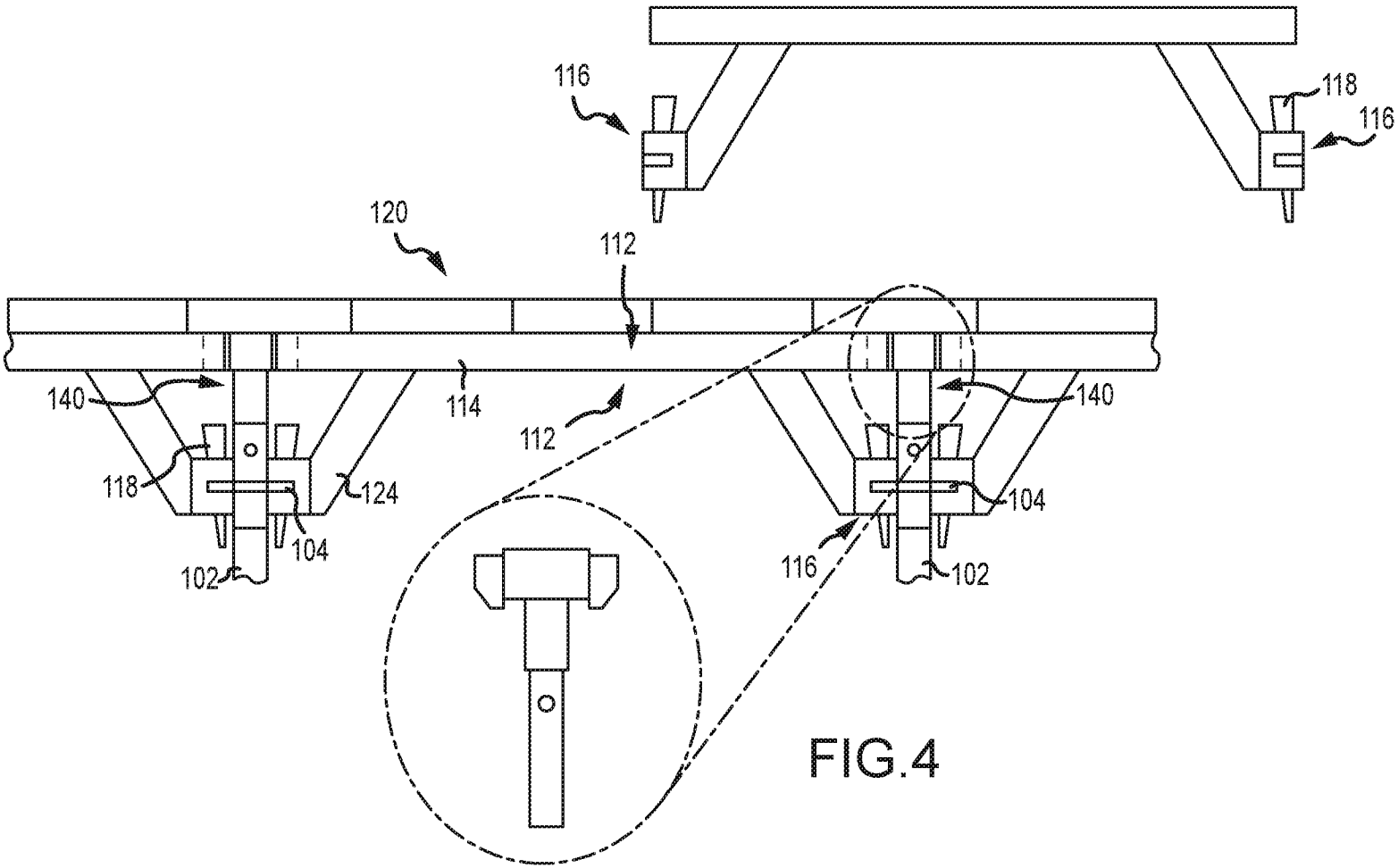
FIG. 4 is a side view of a work platform where the uprights support modified horizontal modular scaffold components at a position above the ends of the uprights.

The modular scaffold system 100 shown in FIG. 4 is a partial sectional view showing two uprights 102 with each of these uprights engaging two horizontal scaffold components 112. The central horizontal scaffold component 112 is supported at one end by vertical member 102 and at the other end by a second vertical member 103. The elongate top support members 114 of the horizontal scaffold components 112 are located above the top edge of the vertical members 102 and 103. The horizontal scaffold components 112 include connecting ledger heads 116 that are located below the elongate top support member 114. Drop wedges 118 are used to connect the ledger heads 116 to securing rosettes 104 of each upright 102 or 103. Each of the uprights 102 and 103 do not have a traditional spigot at the end thereof but include the inventive "T" shaped capping component 140 that is received and supported in an end of each vertical member. The "T" shaped capping components 140 cooperate with uprights 102 and 103 such that a top member 144 aligns with the elongate top support members 114 of the horizontal scaffold components 112. In the preferred embodiment, the "T" shaped capping component includes locating tabs 146 that can engage slots in the ends of the elongate top supporting members 114 to restrict movement of the "T" shaped capping component and restrict movement of the elongate top supporting members. The "T" shaped capping component also includes a securing port 148 that passes through the downward spigot connection 142 that is normally used to secure the "T" shaped capping component to a vertical member 102 or 103 in the manner used by the conventional spigot connection. Typically this involves a securing pin or a nut and bolt type fastener.

With the horizontal scaffold components 112 secured atop vertical members 102 and 103 as shown in FIG. 4, it can be seen that the work platform 120 is continuous across the uprights and is not interrupted due to the mechanical securement of the ledger heads to the uprights or due to a portion of the upright projecting through the work platform. The problems of trip hazards associated with a securing drop wedge projecting above a work platform is avoided and the work platform is continuous as it passes over a vertical member. The "T" shaped capping component 140 is in securement with the upright member and engages the ends of the elongate top support members 114, preventing them from rotating. The top support members 114 maintain alignment with the projection of the vertical members. With this arrangement there is no tendency for the elongate top members 114 as shown in FIG. 4, to rotate out of the plane defined by the supporting uprights.

Each horizontal scaffold component 112 includes the angled support arms 124 provided at opposite ends of the scaffold component. These angled support arms position the ledger heads 116 downwardly of the horizontal scaffold component to connect with a securing rosette 104 at the normal modular position. With this arrangement the elongate top support members 114 are at a level above the upper ends of the vertical members 102.

Figure 5:
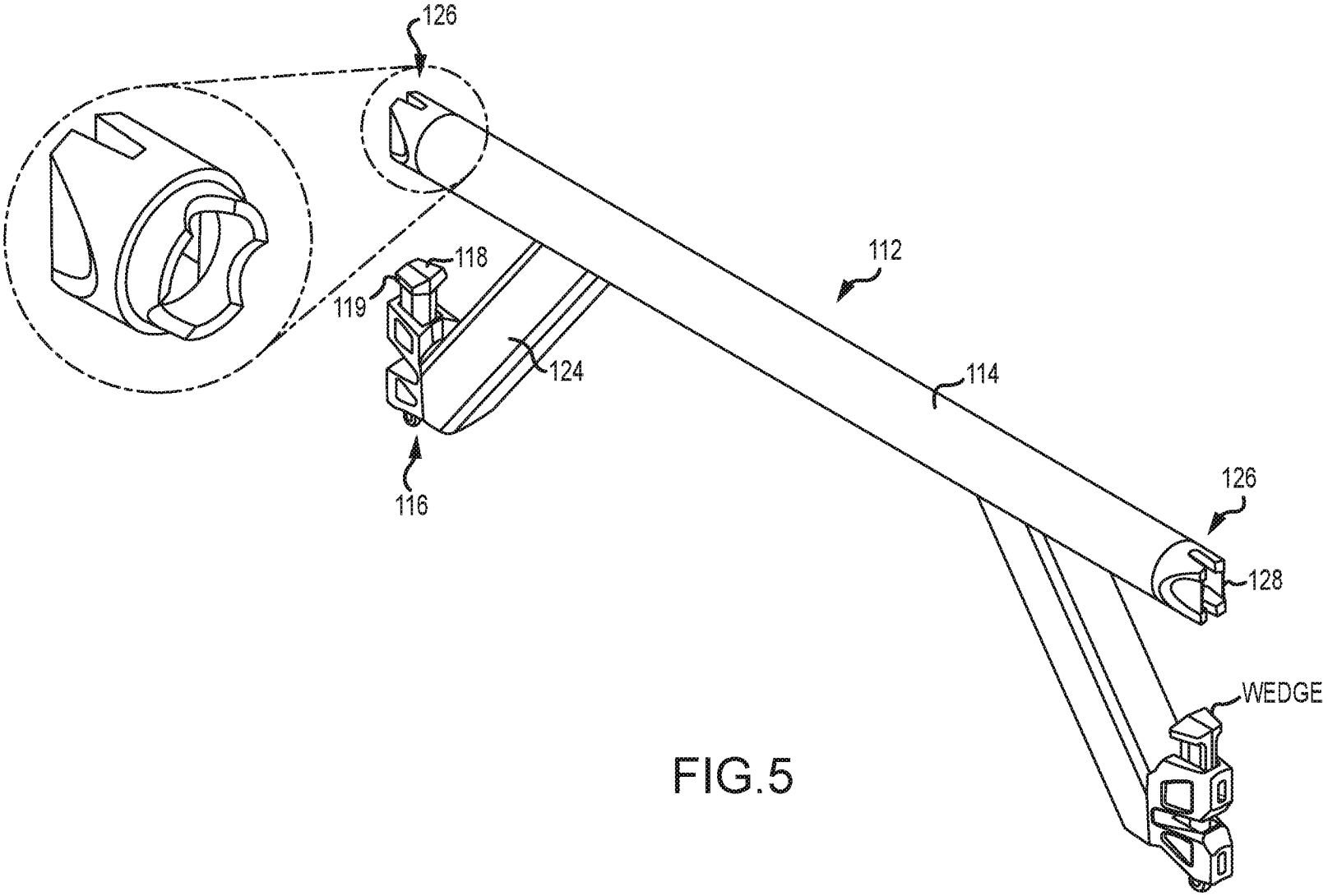
FIG. 5 is a perspective view of a modified horizontal scaffold component for use in supporting a raised work platform.

Further details of the horizontal scaffold component 112 can be realized from a review of FIG. 5. The elongate top support member 114 is positioned above the connecting ledgers 116 due to the angled support arms 124. The elongate top support member 114 is positioned above the upper ends of the vertical members, the horizontal scaffold component continues to connect to the vertical members using the securing rosettes or other securing type structure and sufficient access is provided to allow striking of a drop wedge or other securement of the horizontal scaffold component 112 to a modular upright. The elongate top support member 114 includes end pieces 126 that are typically welded within the tube of the elongate top support member 114. The end pieces 126 include end slots 128 positioned to receive the locating tabs 146 of a "T" shaped capping component 140.

The elongate top support member 114 with the end pieces 126 is of a length approximately equal to the clear space between vertical upright members. In contrast to a conventional ledger that is used as a horizontal support member, the horizontal scaffold component 112 does not directly engage the vertical member at the level of the elongate top support member 114. To overcome this issue the "T" shaped capping component 140 essentially extends the vertical member to position the "T" shaped capping component at the level of the elongate top support member 114. Furthermore, the "T" shaped capping component includes locating tabs 146 that engage slots 128 in the end pieces 126. The "T" shaped capping component forms a specialized extension of an upright.

A problem associated with the horizontal scaffold component 112 is that the drop wedges 118 are located essentially directly below the end pieces 126 and there is not unrestricted clear vertical access to the ends of the drop wedges 118 sufficient for striking thereof. Normally the ends of the drop wedges are fully exposed for hammering of the drop wedges in place. The drop wedges of FIG. 5 have enlarged hammer pads 119 that project outwardly from the vertical axis of the drop wedges and provide a large surface for striking of the wedge from either side thereof. The striking is still mostly downwardly but there is a side component due to the angle of the strike. The enlarged hammer pads make it easier to strike the drop wedge and drive it into a secure position. Preferably the drop wedge is laterally reinforced to reduce the possibility of lateral bending.

Figure 6:
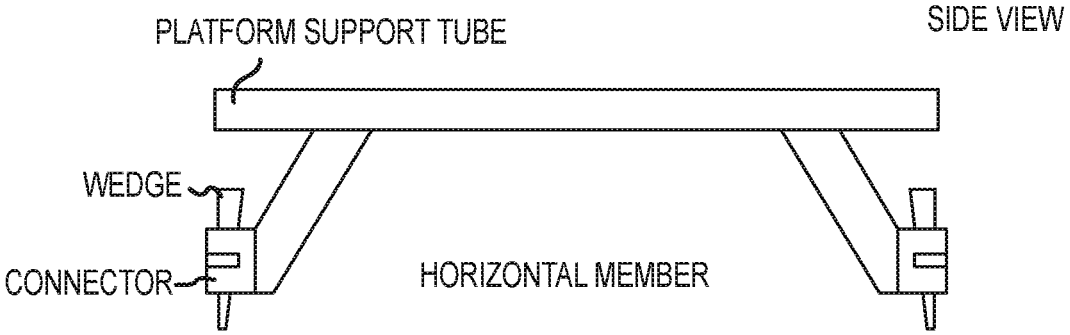
FIG. 6 is a side view of the component of FIG. 5.
Figure 7:
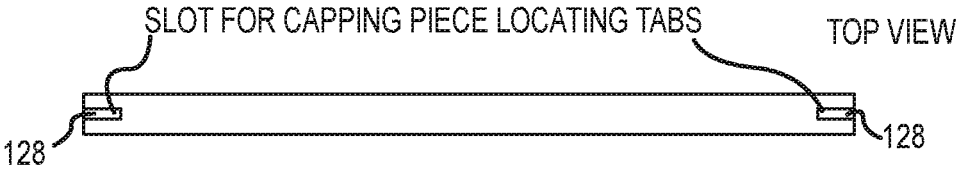
FIG. 7 is a top view of the component of FIG. 5.

Further details of the horizontal scaffold component 112 can be realized from the side view shown in FIG. 6 and the top view shown in FIG. 7.

Figure 8:
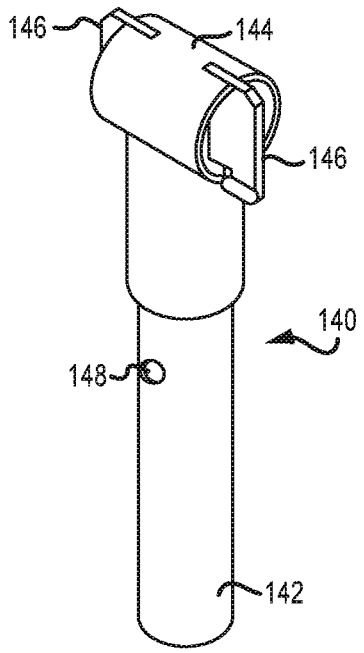
FIG. 8 is a perspective view of the "T" shaped capping component.
Figure 9:
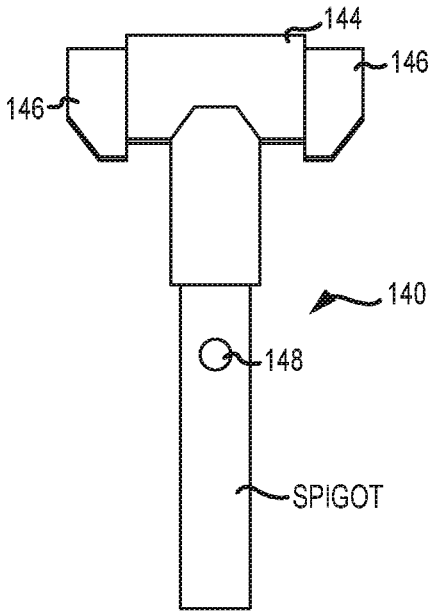
FIG. 9 is a side view of the "T" shaped capping component.

The "T" shaped capping component 140 is shown in the perspective view of FIG. 8 and the side view of FIG. 9. The "T" shaped capping component 140 includes a downward spigot connection 142 that is sized for insertion in the end of a vertical member 102. A downward spigot connection 142 is of the same diameter as the normal spigot connection used to connect two verticals. An important aspect is that the downward spigot connection 142 is inserted in an end of a vertical member 102 and the T" shaped cap component is supported by the vertical member. The top member 144 extends across the downward spigot connection 142 and has locating tabs 146 either side of the downward spigot connection. These locating tabs are positioned to engage slots in the horizontal scaffold component 112. A securing port 148 is provided which allows securement to a vertical member in the same manner as a traditional spigot connector. The "T" shaped cap component also accommodates the continuous work platform.

Figure 10:
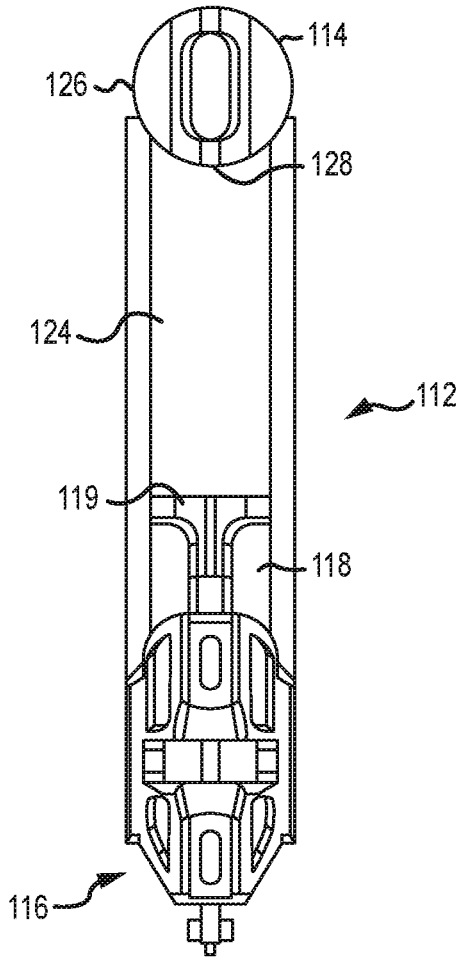
FIG. 10 is an end view of the modified horizontal scaffold component.

FIG. 10 shows additional details of an end view of the horizontal scaffold component 112 showing the relationship of the elongate top support member 114, the angled support arm 124, the end pieces 126 having the ends slots 128 as well as details of the ledger heads 116 and the drop wedge 118 with the projecting hammer pads 119.

Figure 11:
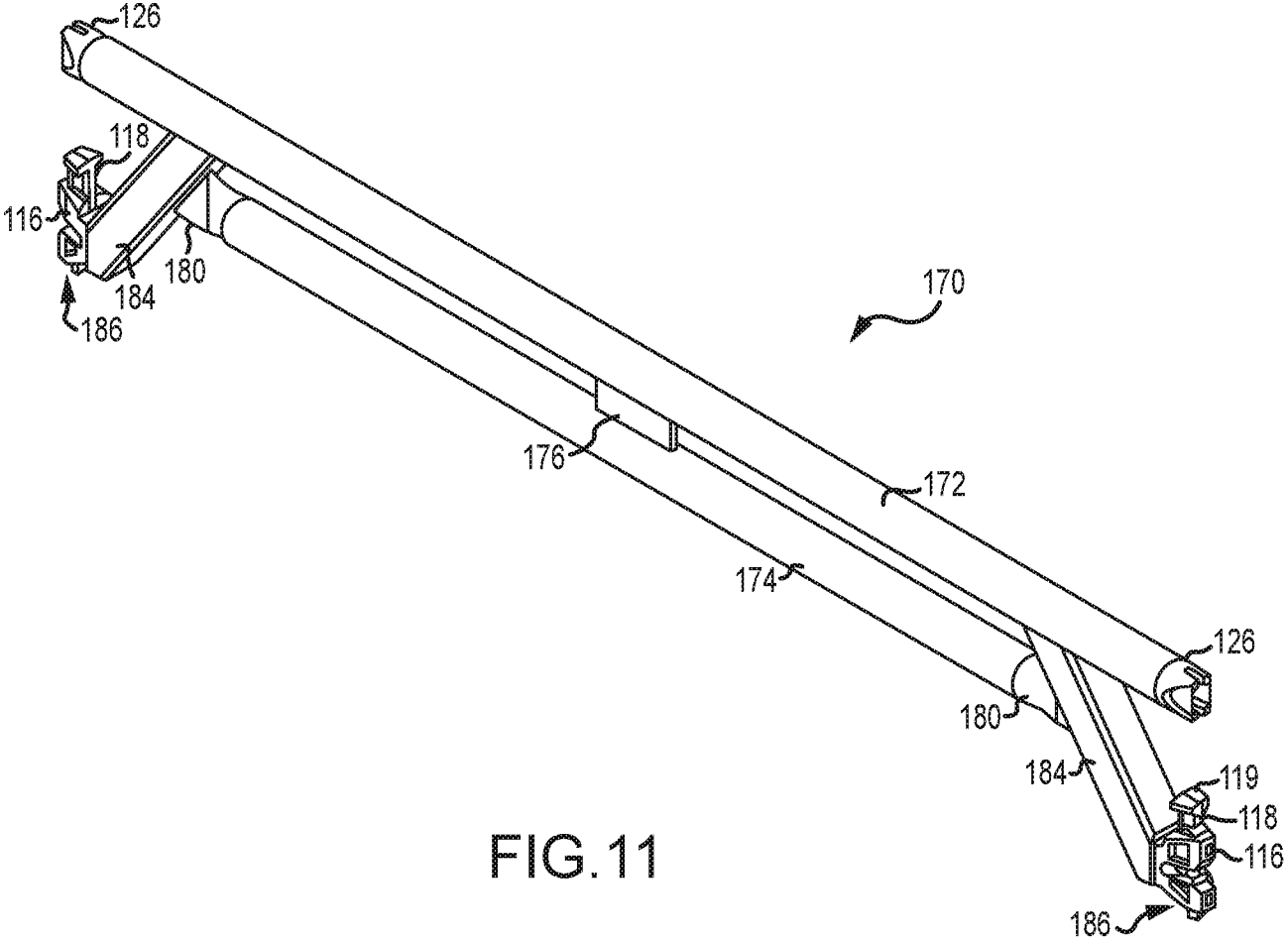
FIG. 11 is a side perspective view of a high load horizontal scaffold component.

FIG. 11 shows a higher load bearing horizontal member 170 that works much in the manner of the horizontal scaffold component 112. An elongate top support member 172 cooperates with a lower horizontal member 172 and is connected to the top support member 172 by the central structural connector 176. With this structure any load placed on the top support member 172, is partially transmitted to the lower horizontal member 174 and there is less deflection of the elongate top support member 172. The lower horizontal member 174 is welded to the diagonal support arms 184 that also have a fixed or weld connection with the elongate top support member 172. The elongate top support member 172 includes the end pieces 126 which are typically welded to this member. Similarly the diagonal support arms 124 include the ledger heads 116 welded to the support arms.

Figure 12:
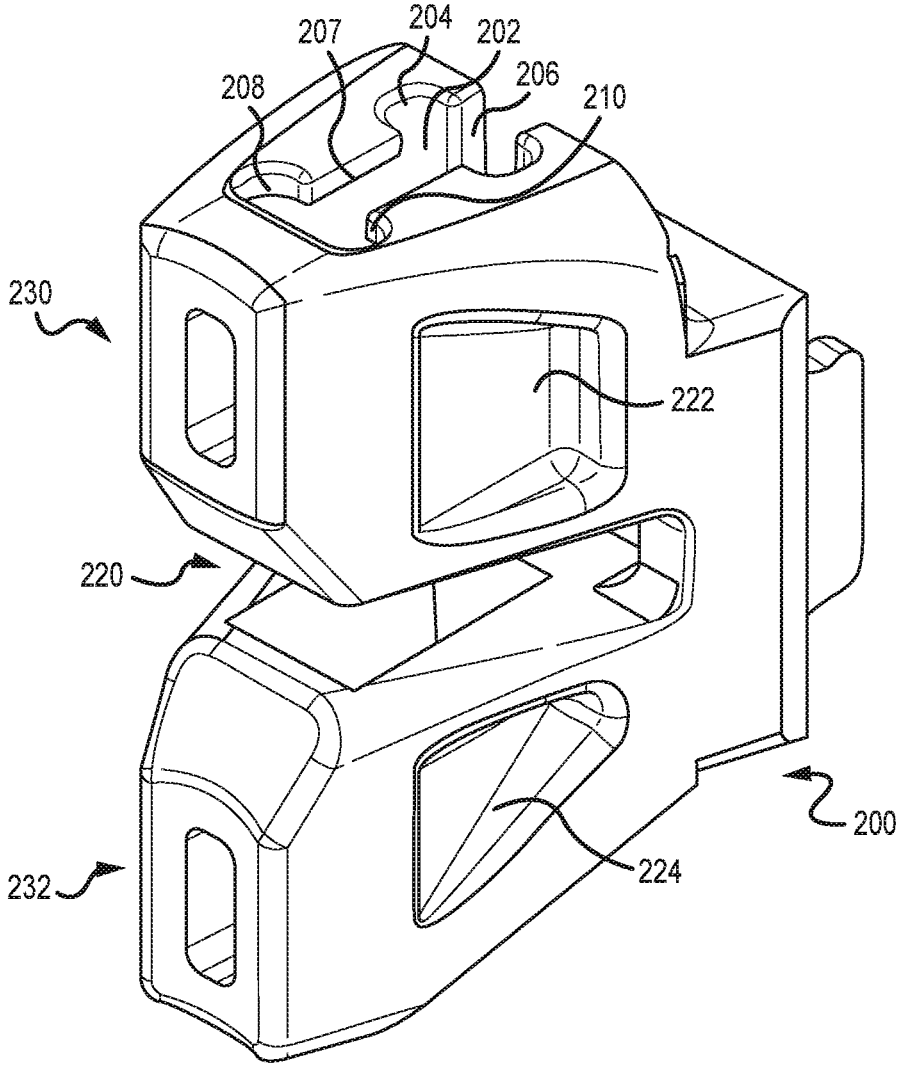
FIG. 12 is a perspective view of a modified ledger head.
Figure 13:
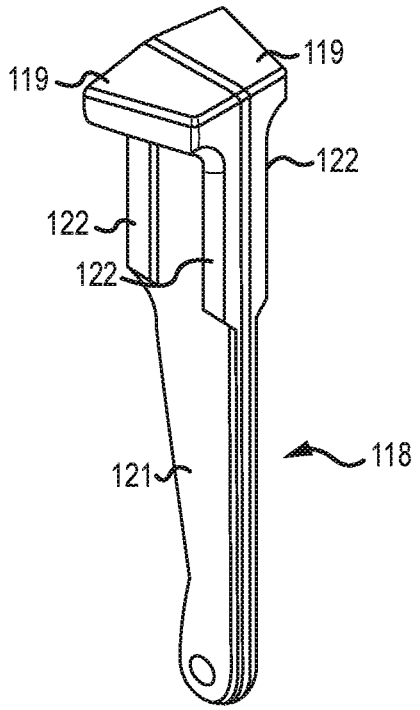
FIG. 13 is a perspective view of a reinforced drop wedge with hammer pods.
Figure 14:
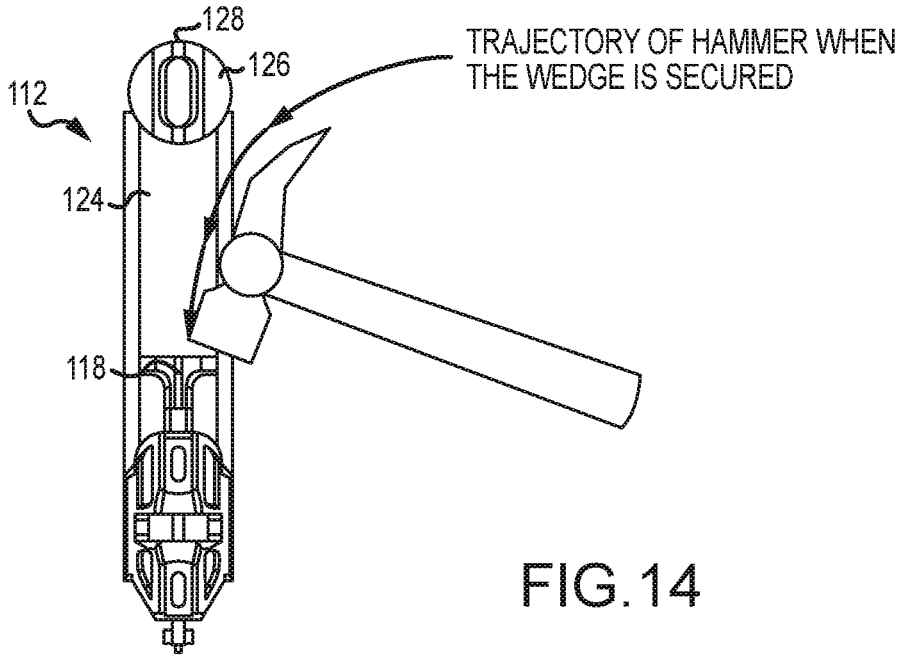
FIG. 14 is an end of the horizontal scaffold component illustrating driving of the reinforced wedge.

A modified ledger head 200 is shown in FIG. 12 that is adapted to receive the modified drop wedge of FIG. 13. As previously described, access to strike the drop wedge 118 downwardly is partially restricted as shown in FIG. 14. To provide assistance in driving of the drop wedge 118 downwardly, the drop wedge 118 has been provided with the outwardly extending hammer pads 119. Furthermore as striking of the drop wedge 118 is not as precise as one would like, it is likely that the drop wedge 118 will be exposed to damaging side loads that occur from improper striking of the drop wedge 118. As shown in FIG. 13 reinforcing ribs 122 are provided at an upper portion of the drop wedge 118 and exterior to a body portion 121 of the drop wedge 118.

The body portion 121 of the drop wedge 118 can be of a laminate plate type structure as shown in FIG. 13. The plate members can be secured in any number of conventional ways such that the body portion 121 is unitary. The hammer pads 119 and the reinforcing ribs 122 below the hammer pads 119 are preferably welded to the body portion 121. Similarly the hammer pads 119 can be also secured to each other by welding. With this arrangement the drop wedge 118 at a position below the hammer pads 119 and within the length of the reinforcing ribs 122, has an hourglass type configuration, i.e. it has a narrower center portion and enlarged end portions. This shape accommodated in the modified ledger head 200 as the wedge receiving slot 202 has a similar shape. This shape includes the cut-outs 204 and 206 at one end of slot 202 for receiving reinforcing members. A central portion 207 sized to receive the body portion 121 and cut-outs 208 and 210 at the opposite end of the wedge receiving slot 202.

The modified ledger head 200 includes a connection slot 220 for receiving a connecting rosette of an upright member and the drop wedge 118 will pass through this connection slot and engage a lower portion of the ledger head. The modified ledger head 200 also includes upright engaging faces 230 and 232 that will engage an upright member either side of a connecting rosette.

The modified ledger head also includes a series of cavities 222 and 224, for reducing weight and assisting in manufacture, and do not adversely affect the overall strength of the modified ledger head 200.

The preferred drop wedge 118 as shown in FIG. 13 is quite stiff at the upper portion of the wedge making it less prone to damage caused by inadvertent lateral loading of the wedge. FIG. 14 shows how a user can drive the wedge 118 downwardly while striking the wedge slightly off center. The oversized hammer pads 119 in combination with the stiffening ribs 122 provided at the upper end of the wedge provide a simple solution for providing a relatively stiff wedge that is not prone to damage due to inadvertent side loading which may be created during forced downward movement of the wedge in a securing action.

Figure 16:
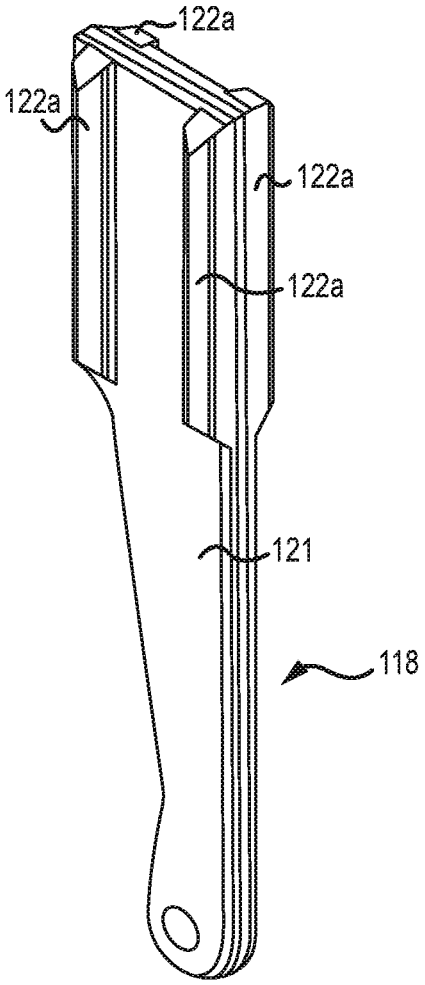
FIG. 16 is a perspective view of a preferred drop wedge.

FIG. 16 shows a modified drop wedge 118*a* that has four downwardly extending reinforcing ribs 122*a* welded to the body portion 121. This drop wedge 118*a* does not include the outwardly extending hammer pads 119. The reinforcing of the drop wedge 118*a* with the vertical ribs 122*a* may be sufficient for many applications. The extending hammer pads 119 (shown in FIG. 13) are particularly helpful if the distance between the drop wedge 118 and the top of the elongate support member is relatively tight. If there is additional spacing, it is easier to strike the top of the wedge with a vertical strike and the wedge is less prone to damage.

Figure 15:
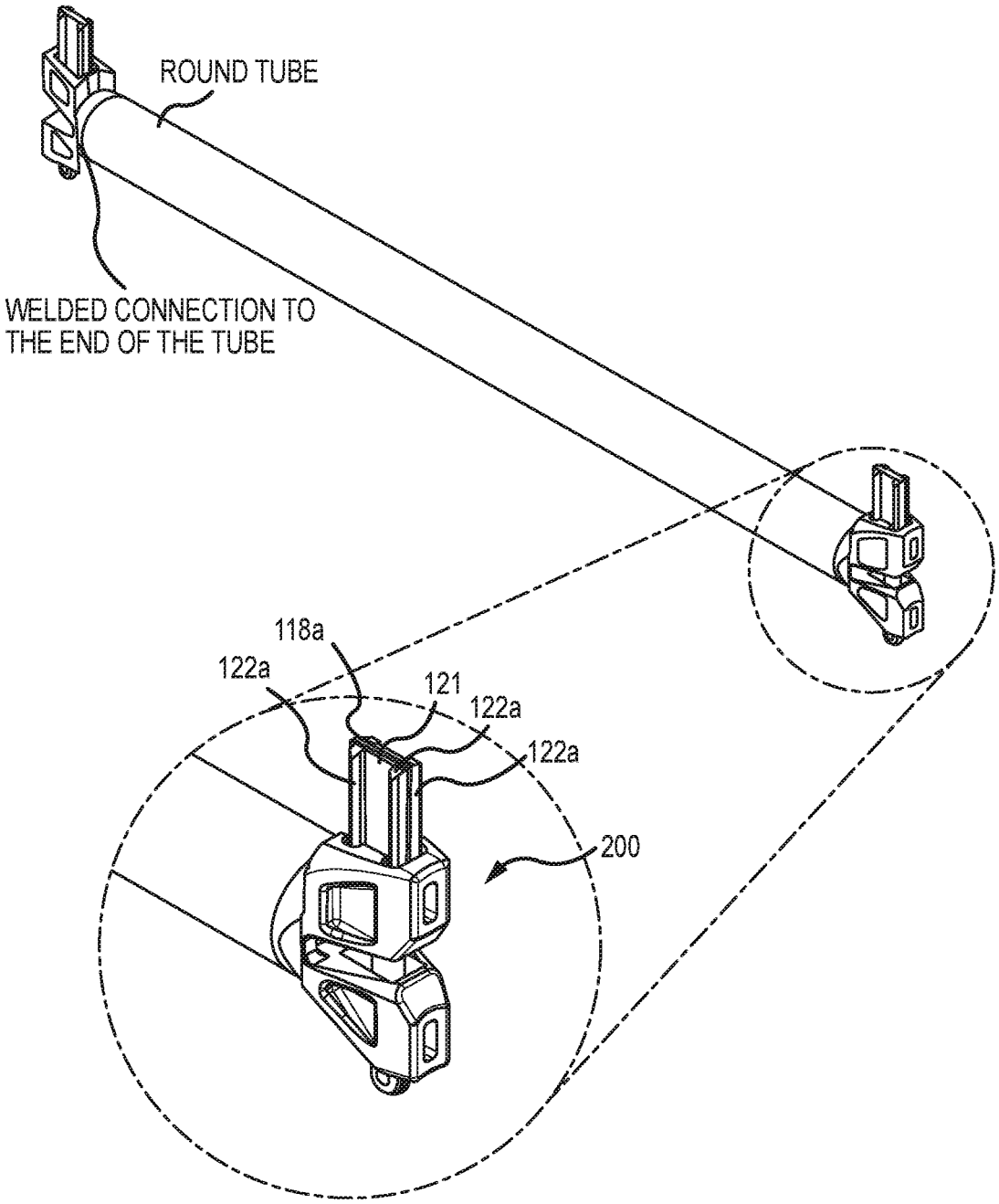
FIG. 15 is a partial perspective of a ledger with a modified drop wedge and cooperating ledger head.

FIG. 15 shows the use of the modified wedge 118*a* in combination with a horizontal ledger that has the preferred ledger head 200 as shown in FIG. 12.

There is no requirement for hammer pads as the top surface of the drop wedge will be easily accessed and not impeded by any portion of the ledger that would be thereabove. This is in contrast to the modified horizontal component where access for driving of the drop wedge is restricted.

For some applications, it may be necessary to have a larger span between vertical members and a girder structure 300 as shown in FIG. 16 can be used. The girder structure is modified in the manner similar to the horizontal scaffold component 112 in that the girder structure includes limited access ledger connections 312 and 314. Each of these connections are below the raised upper horizontal member 302 which has been broken into two components that are connected by small angle bracing members 307. The girder structure 300 also includes a lower horizontal member 304 with the raised upper horizontal member 302 connected to the lower horizontal member 304 by diagonal braces 306. The girder at opposite ends thereof include vertical end members 308 and 310 which have ledger heads attached thereto for connection to securing rosettes provided on the vertical members 102. The lower horizontal member 304 has a conventional type ledger connection 316 and 318 at opposite ends thereof for connection to the vertical members 102 and limited access ledger connections 312 and 314 where access is restricted due to the raised upper horizontal member.

Figure 17:
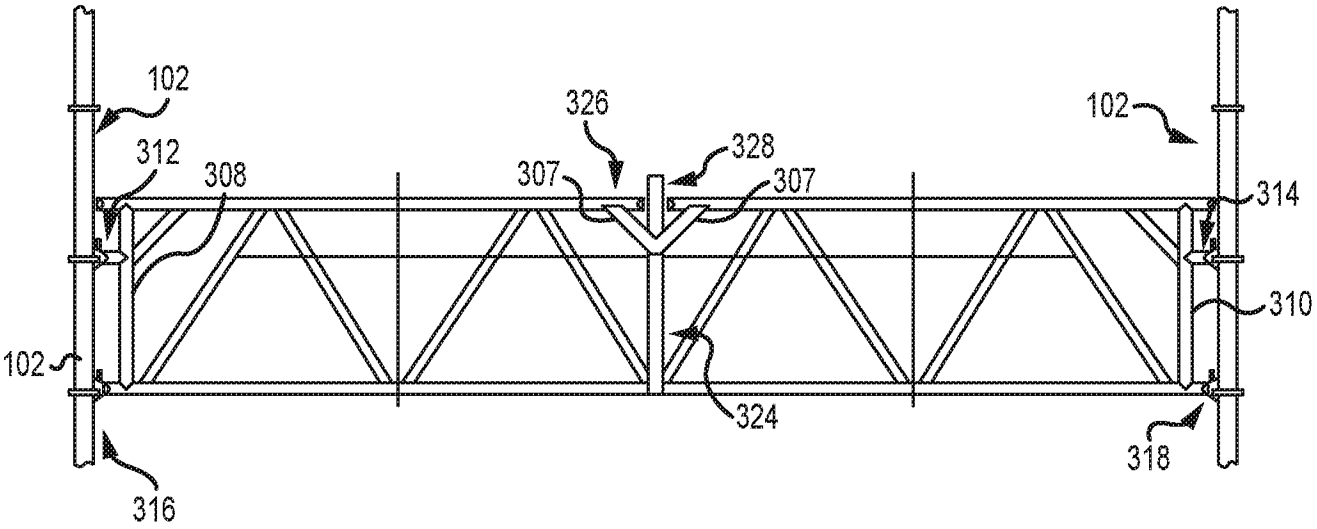
FIG. 17 is a side view of a girder structure.
Figure 18:
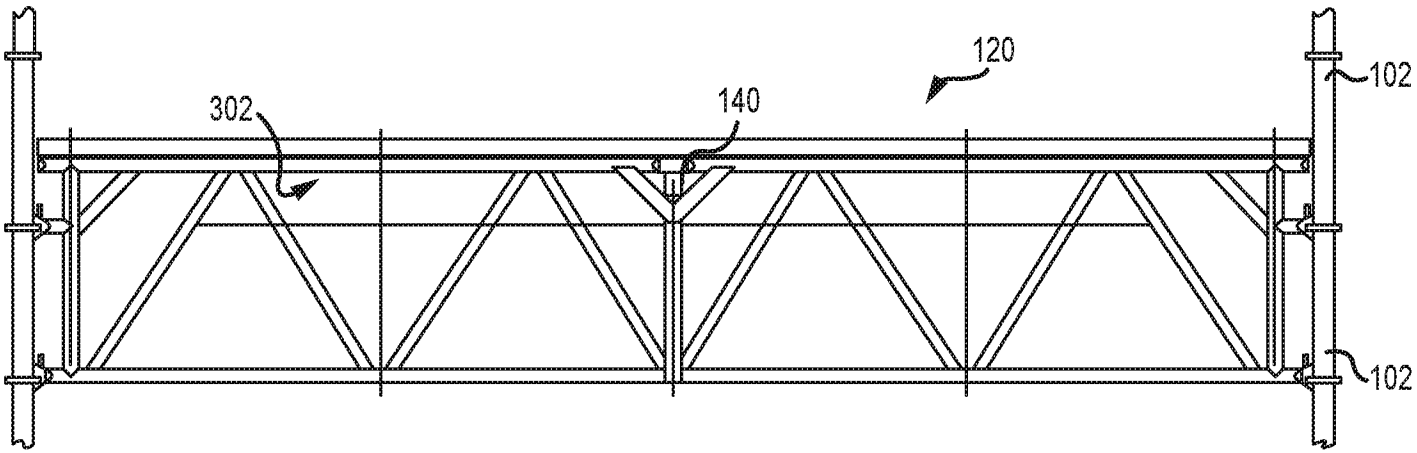
FIG. 18 is a side view of a girder structure supporting a working platform.

Centrally within the length of the girder structure 300 is a center vertical member 324 which connects the lower horizontal member to the raised upper horizontal member due to the smaller diagonal brace members 307. The upper portion of center vertical member 324 is open and can receive the "T" shaped capping component 140 as shown in FIG. 18. It can also receive a spigot type connection 328 as shown in FIG. 17. With the spigot connection as shown in FIG. 17, it is possible to provide a further vertical member located on and supported by the girder structure. This is sometimes needed when a scaffold structure must be built over an opening.

In FIG. 18 the girder structure 300 has the "T" shaped capping component 140 in engagement with the center vertical member 324 and a continuous work surface 120 is provided above the raised upper horizontal member 302. As can be appreciated, the girder structure 300 includes two connection points to each vertical and thus it is not as critical to further engage the raised upper horizontal member at a vertical upright such as 102. Also it can be seen in FIG. 18 that two vertical uprights 102 are stacked relative to each other at the end of the girder structure and this connection is preferably a spigot type connection. It is not necessary to have a direct securement of the raised upper horizontal member and the vertical member 102 at the point of abutment with the vertical member 102.

The girder structure 300 includes the principle of raising the upper horizontal member above a rosette connector to allow for a continuous work platform above the connection point with the wedge and the ledger head connection being located below this level.

Figure 19:
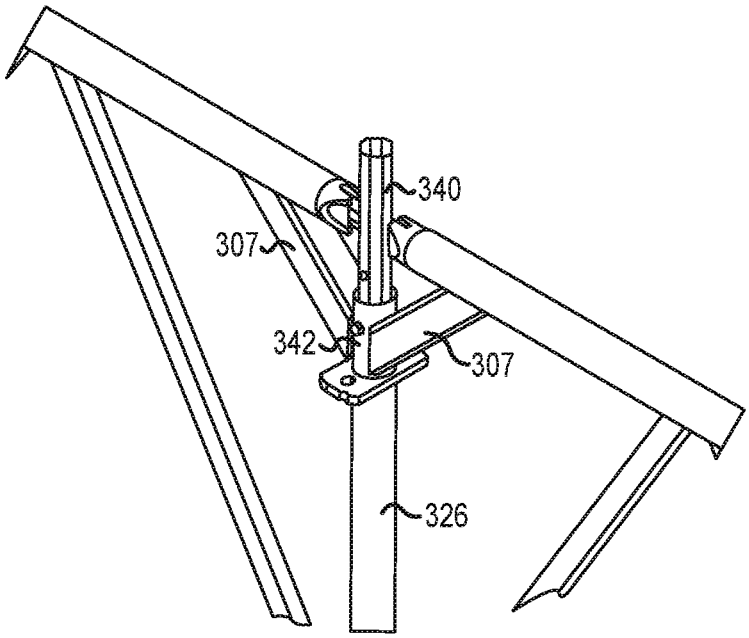
FIG. 19 is a partial perspective view of a spigot connection intermediate the length of a girder structure.
Figure 20:
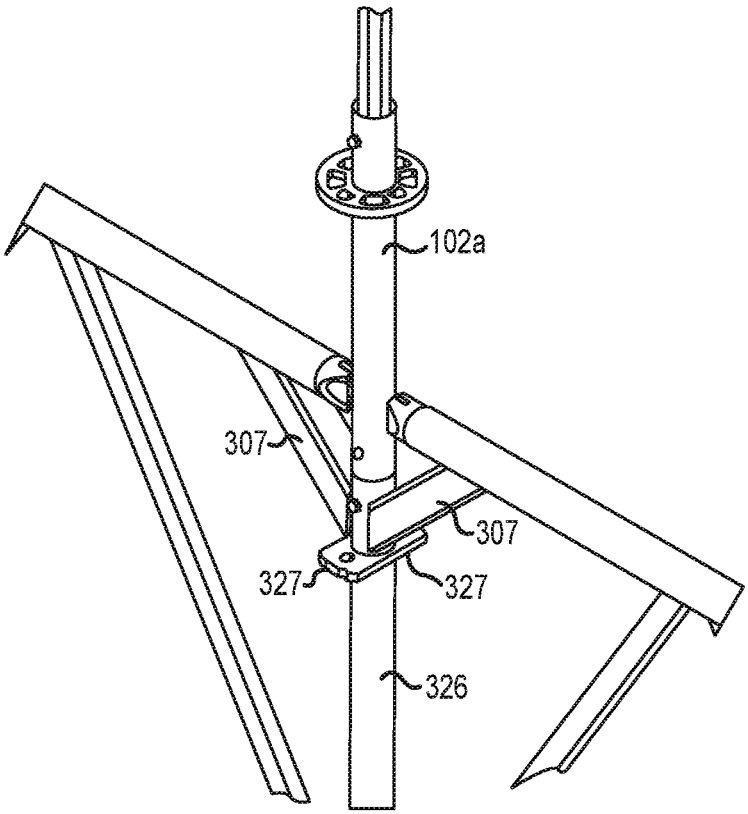
FIG. 20 shows a girder structure supporting a vertical upright at a position intermediate its length.

FIGS. 19, 20, 21 and 22 show additional details of the girder structure 300. FIG. 19 shows details of the spigot tube connector that is shown centrally in FIG. 17. The vertical member 102*a* engages a spigot (not shown) that is received and secured in the vertical member 326. It can be seen that there is a gap of sufficient size above vertical member 326 to receive the vertical member 102*a*. FIG. 19 shows the center connection 326 having the spigot tube 340 inserted in the center vertical member 234 and maintained at a position in this member due to the bolt securement 342. This spigot connection 340 can then receive the vertical member 102*a* as shown in FIG. 20. FIGS. 19 and 20 show additional details of the short diagonal brace members 307.

Figure 21:
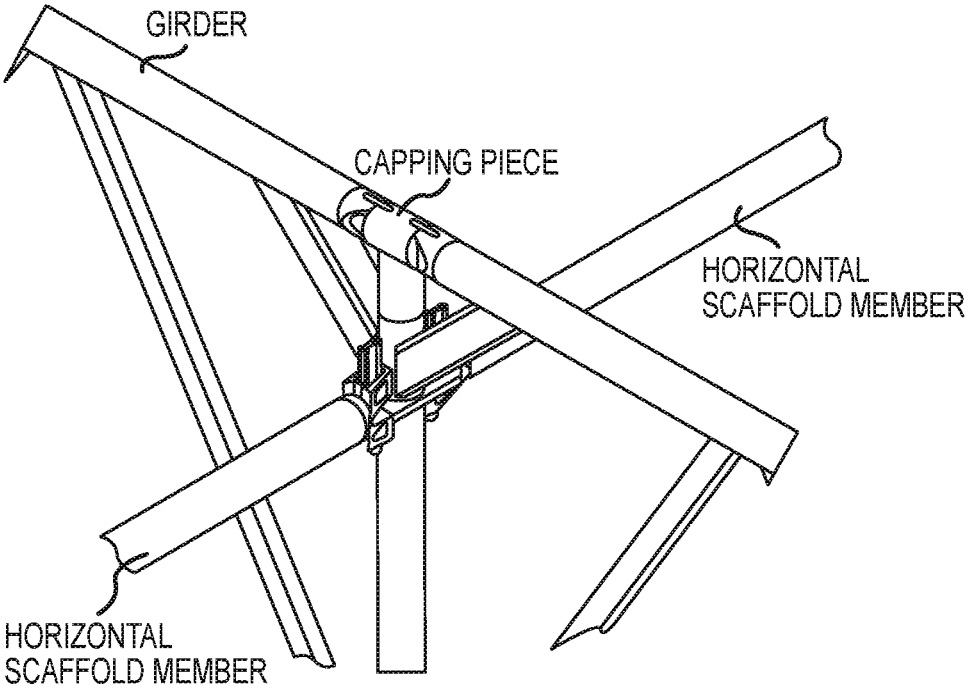
FIG. 21 is similar to FIG. 20 with the girder structure support a "T" capping component.
Figure 22:
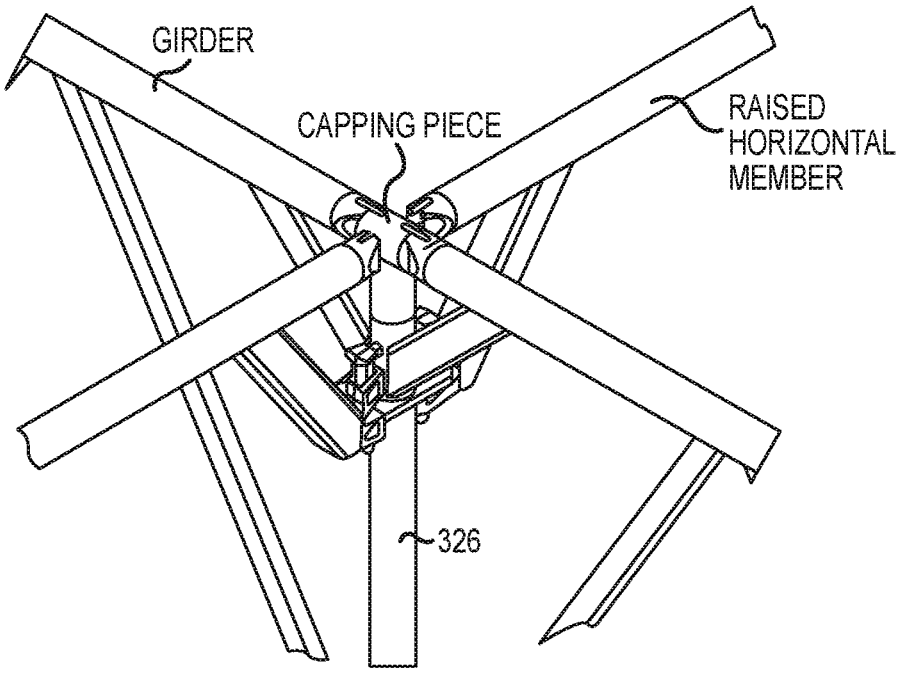
FIG. 22 is a girder structure supporting perpendicular ledger components.

In other applications, the girder structure 300 will receive the "T" shaped capping component 140 as clearly shown in FIG. 21. In addition, it can be seen that the center connection member 326 can include outwardly extending flanges 327 with ports for connecting with a drop wedge. FIG. 21 shows how a horizontal ledger member with a ledger head at one end thereof, can be connected to the center connection member 326. In FIG. 22, the girder structure 300 receives the "T" shaped capping component 140 and is also mechanically secured to the horizontal scaffold component 112 by means of the ledger head 200 and drop wedge. This allows for support of a continuous work platform over the center connection member 326.

The present invention shows a number of modular scaffold components and in particular horizontal connecting scaffold components that can attach to vertical members in a conventional type connection while providing a raised horizontal support structure that can receive a work platform. Different arrangements are shown to allow this work platform to be continuous over a vertical member which provides the support therebelow.

Although preferred embodiments of the invention have been described herein in detail, it may be understood by those skilled in the art that variations made thereto without departing from the invention as defined in the appended claims.

The invention claimed is:

1. A horizontal scaffold component comprising an elongate top support member for supporting platform members; said elongate top support member at each end thereof having a connecting member adapted to releasably connect with a conventional scaffold type upright;

each connecting member being located downwardly of and beneath said elongate top support member and including a drop wedge captured on said horizontal scaffold component and movable downwardly into the connecting member to an engaged position allowing releasable connection with conventional scaffold type uprights;

each drop wedge being movable upwardly towards said elongate top support member into a clear space between said elongate top support member and the connecting member to a release position of said drop wedge; and wherein each drop wedge includes at a top thereof outwardly extending hammer pads of sufficient size to accommodate downwardly angled side striking of the wedge for movement between said release position and said engaged position, wherein the horizontal scaffold component is in combination with a "T" shaped capping component comprising a downwardly extending upright connection engagable with an upper end of said conventional scaffold type upright such that a top member of said "T" shaped capping component extends across said upright connection, the "T" shaped capping component aligned and engaged with the elongate top support member to provide a continuous surface for work platforms to be supported on the "T" shaped capping component and the elongate top support member without interruption over said conventional scaffold type upright.

2. A horizontal scaffold component as claimed in claim 1 wherein each drop wedge includes separate reinforcing ribs extending vertically downwards either side of said wedge and downwardly from said hammer pads.

3. A horizontal scaffold component as claimed in claim 2 wherein each reinforcing rib is a metal rib welded to the drop wedge on a side of the drop wedge and secured at a vertical edge of the drop wedge.

4. A horizontal scaffold component as claimed in claim 3 wherein each drop wedge includes 4 reinforcing ribs.

5. A horizontal scaffold component as claimed in claim 1 wherein said "T" shaped capping component comprises a downwardly extending spigot connection and a top member extends across said spigot connection with vertically extending locating tabs centered on said top member with a locating tab at opposite ends of said top member.

6. A horizontal scaffold component as claimed in claim 5 wherein said horizontal scaffold component includes a vertically extending slot at each end of said elongate top support member sized to receive a locating tab of said "T" shaped capping component tab to align said top member of said capping component with said elongate top support member.

7. A horizontal scaffold component as claimed in claim 6 wherein said "T" shaped capping component includes a projecting support surface extending outwardly from said spigot connection at a position spaced below said top member a distance to assist in aligning said top member with the elongate top member for supporting a platform.

8. A horizontal scaffold component as claimed in claim 7 wherein each connecting member is a ledger head having a scaffold post engaging face at an outer end thereof, and wherein said elongated top support member is of a length generally equal to the distance between the scaffolding post engaging faces of the ledger heads.

9. A horizontal scaffold component as claimed in claim 8 wherein said elongated top support member at each end thereof includes a cap member that includes as part thereof the respective vertically extending slot.

10. A scaffold system comprising a vertical upright extending between a top end and a bottom end, a "T" shaped capping component that includes a bottom member removably coupled with the top end of the vertical upright and top member that extends horizontally relative to the bottom member, and a horizontal scaffold component configured to support a work platforms thereon, the horizontal scaffold component including an elongate top support member for supporting the work platforms above ground underlying the horizontal scaffold component, a support arm that extends downwardly away from the elongate top support member, and a connecting member coupled with the support arm and located entirely below the elongate top support member, and the connecting member having a ledger head coupled with the support arm and a drop wedge interlocked with the ledger head and the vertical upright to couple the horizontal scaffold component with the vertical upright, wherein the top member of the "T" shaped capping component and the elongate top support member are aligned vertically to allow a work platform supported on the elongate top support member to extend over the top member and the vertical upright and provide a continuous surface over the elongate top support member, the "T" shaped capping component, and the vertical upright.

11. The horizontal scaffold system as claimed in claim 10 wherein the elongate top support member extends horizontally between a first terminal end and a second terminal end thereof, the first terminal end is formed to define a slot, and the top member of the "T" shaped capping component has a locating tab that extends into the slot defined in the first terminal end to block rotation of the elongate top support member relative to the vertical upright.

12. A scaffold system comprising a series of conventional scaffold type uprights releasably connectible to any of a series of horizontal scaffold components and a series of platform members securable between opposed horizontal scaffold components for forming a continuous work surface above supporting conventional scaffold type uprights; wherein each horizontal scaffold component comprises an elongate top support member for supporting any of said platform members;

said elongate top support member at opposite ends thereof having a connecting member adapted to releasably connect with any of said conventional scaffold type uprights;

said connecting members being located downwardly of said elongate top support member and including a drop wedge movable downwardly into said connecting member for releasable connection with any of said conventional scaffold type uprights;

each drop wedge being movable upwardly towards said elongate top support into a clear space between said elongate top support member and the respective connecting member; and wherein said scaffold system includes a series of "T" shaped capping components with each a "T" shaped capping component comprising a downwardly extending upright connection engagable with an upper end of any of said conventional scaffold type uprights such that a top member of said "T" shaped capping component extends across said upright connection forming an extension of two aligned top members of horizontal scaffold components secured at the upper end of one of said conventional scaffold type uprights.

* * * * *